US005907882A

United States Patent [19]

Tyree

[11] Patent Number: 5,907,882

[45] Date of Patent: Jun. 1, 1999

[54] LOTTERY TICKET SCRATCH OFF DEVICE

[76] Inventor: Bill Tyree, 5140 Lakeview Dr., Smithville, Tex. 78957

[21] Appl. No.: 08/974,063

[22] Filed: Nov. 19, 1997

[51] Int. Cl.[6] ..... A46B 13/02

[52] U.S. Cl. ..... 15/77; 15/88.3; 15/102

[58] Field of Search ..... 15/77, 93.1, 88.2, 15/88.3, 102, 38, 39, 412, 413, 21.2, 3.1, 308, 311, 100, 23

[56] References Cited

U.S. PATENT DOCUMENTS

| | | | |
|---|---|---|---|
| 3,242,517 | 3/1966 | Buros et al. | 15/77 |
| 3,266,074 | 8/1966 | Wehr | 15/77 |
| 3,440,675 | 4/1969 | Yeaman | 15/102 |
| 3,846,816 | 11/1974 | Gaisser | 15/77 |
| 3,938,213 | 2/1976 | DiFede | 15/77 |
| 3,995,343 | 12/1976 | Horner | 15/77 |
| 4,081,815 | 3/1978 | Horner | 15/77 |
| 4,703,537 | 11/1987 | Yamamoto et al. | 15/77 |
| 4,740,075 | 4/1988 | Schoering | 15/77 |
| 4,765,842 | 8/1988 | Sanders et al. | 15/77 |
| 4,926,520 | 5/1990 | Watson | 15/77 |
| 5,355,543 | 10/1994 | Cameron et al. | 15/77 |
| 5,402,549 | 4/1995 | Forrest | 15/77 |

*Primary Examiner*—Gary K. Graham

[57] ABSTRACT

A lottery scratch off device is provided including a housing. A scratch assembly is situated within the housing and includes at least one roller and brush associated therewith. A motor is connected to the scratch assembly for rotating the roller and brush upon the receipt of power. Finally, a switch is mounted on the housing for effecting the selective supply of power to the motor.

2 Claims, 2 Drawing Sheets

LOTTERY TICKET SCRATCH OFF DEVICE

BACKGROUND OF THE INVENTION

1. Field of the Invention

The present invention relates to lottery scratch off apparatuses and more particularly pertains to a new lottery ticket scratch off device for conveniently removing latex or the like from a lottery ticket.

2. Description of the Prior Art

The use of lottery scratch off apparatuses is known in the prior art. More specifically, lottery scratch off apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art lottery scratch off apparatuses include U.S. Pat. No. 4,765,842; U.S. Pat. No. 5,402,549; U.S. Pat. No. 5,253,383; U.S. Pat. No. 5,419,004; U.S. Pat. No. 5,355,543; and U.S. Pat. Des. No. 338,755.

In these respects, the lottery ticket scratch off device according to the present invention substantially departs from the conventional concepts and designs of the prior art, and in so doing provides an apparatus primarily developed for the purpose of conveniently removing latex or the like from a lottery ticket.

SUMMARY OF THE INVENTION

In view of the foregoing disadvantages inherent in the known types of lottery scratch off apparatuses now present in the prior art, the present invention provides a new lottery ticket scratch off device construction wherein the same can be utilized for conveniently removing latex or the like from a lottery ticket.

The general purpose of the present invention, which will be described subsequently in greater detail, is to provide a new lottery ticket scratch off device apparatus and method which has many of the advantages of the lottery scratch off apparatuses mentioned heretofore and many novel features that result in a new lottery ticket scratch off device which is not anticipated, rendered obvious, suggested, or even implied by any of the prior art lottery scratch off apparatuses, either alone or in any combination thereof.

To attain this, the present invention generally comprises a housing having a rectilinear configuration. As shown in the Figures, the housing is equipped with a top face, a bottom face, a pair of elongated side faces, and a pair of short end faces thereby defining an interior space. The top face has a square opening formed therein with a recessed peripheral lip formed about a periphery thereof. For reasons that will become apparent hereinafter, the end faces each have an elongated slot extending between the side faces and further positioned adjacent the bottom face of the housing. As best shown in FIGS. 3 & 4, a scratch assembly is provided including a planar square plate with a top face, a bottom face, and a periphery formed therebetween. The bottom face includes an elongated linear rectangular strip integrally coupled thereto and extending downwardly therefrom along one of the edges thereof. An elongated linear rectangular box is also coupled to the bottom face of the scratch assembly and extends downwardly therefrom along one of the edges opposite that associated with the strip. A pair of elongated elastomeric cylindrical rollers are included with a smooth outer surface rotatably coupled between the strip and box at opposite ends thereof. An elongated brush with a cylindrical configuration is also included. A plurality of wire bristles extend radially from the brush. The brush is rotatably coupled between the strip and box.

During use, the scratch assembly is adapted to be removably secured to the housing such that the brush and rollers are situated within the interior space of the housing in abutment with the bottom face of the housing. Further in such position, the bottom face of the scratch assembly is in abutment with the peripheral lip associated with the opening of the housing. Also included is a motor mounted to the bottom face of the scratch assembly for rotating upon the receipt of power. Associated therewith is a gear assembly situated within the box and connected to a rotor of the motor, brush and rollers. Upon the rotation of the motor, the gear assembly is adapted to rotate the rollers in a first direction and the brush in a second direction opposite the first direction. As such, when the rollers are rotated, a lottery ticket may be situated within one of the slots of the housing and the same is slid through the housing beneath the brush so that scratch off material of the lottery ticket is removed. For controlling the motor, a switch is mounted on the top face of the housing and connected between the motor and at least one battery. The switch has a first orientation for supplying power to the motor and a second orientation for precluding the supply of power to the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lottery ticket scratch off device apparatus and method which has many of the advantages of the lottery scratch off apparatuses mentioned heretofore and many novel features that result in a new lottery ticket scratch off device which is not anticipated, rendered obvious, suggested, or even implied by any of the prior art lottery scratch off apparatuses, either alone or in any combination thereof.

It is another object of the present invention to provide a new lottery ticket scratch off device which may be easily and efficiently manufactured and marketed.

It is a further object of the present invention to provide a new lottery ticket scratch off device which is of a durable and reliable construction.

An even further object of the present invention is to provide a new lottery ticket scratch off device which is susceptible of a low cost of manufacture with regard to both materials and labor, and which accordingly is then susceptible of low prices of sale to the consuming public, thereby making such lottery ticket scratch off device economically available to the buying public.

Still yet another object of the present invention is to provide a new lottery ticket scratch off device which provides in the apparatuses and methods of the prior art some of the advantages thereof, while simultaneously overcoming some of the disadvantages normally associated therewith.

Still another object of the present invention is to provide a new lottery ticket scratch off device for conveniently removing latex or the like from a lottery ticket.

Even still another object of the present invention is to provide a new lottery ticket scratch off device that includes a housing. A scratch assembly is situated within the housing and includes at least one roller and brush associated therewith. A motor is connected to the scratch assembly for rotating the roller and brush upon the receipt of power. Finally, a switch is mounted on the housing for effecting the selective supply of power to the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
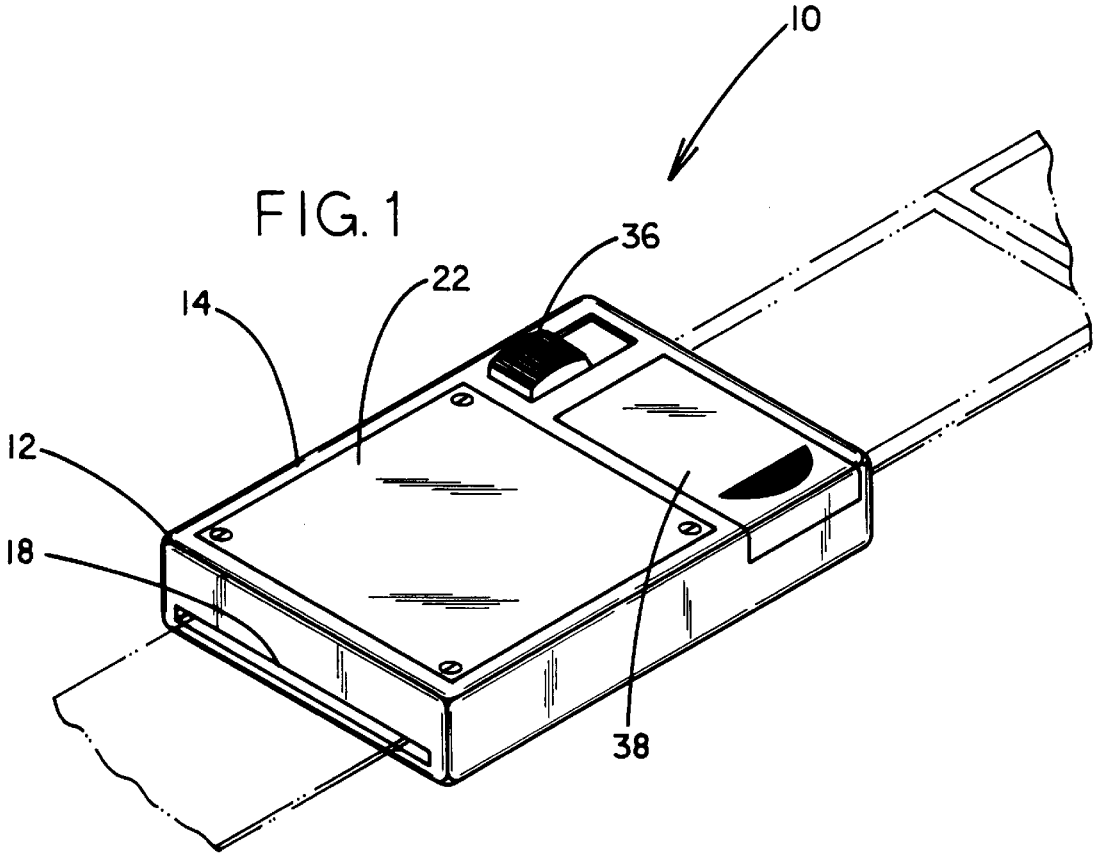
FIG. 1 is a perspective view of a new lottery ticket scratch off device according to the present invention.
Figure 2:
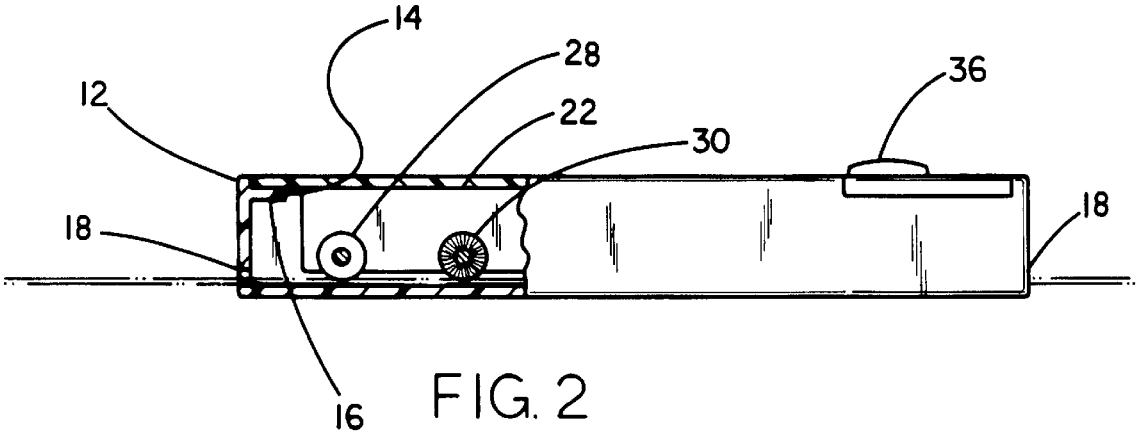
FIG. 2 is a side view of the present invention.

With reference now to the drawings, and in particular to FIGS. 1 through 4 thereof, a new lottery ticket scratch off device embodying the principles and concepts of the present invention and generally designated by the reference numeral 10 will be described.

The present invention, as designated as numeral 10, includes a housing 12 having a rectilinear configuration. As shown in the Figures, the housing is equipped with a top face, a bottom face, a pair of elongated side faces, and a pair of short end faces thereby defining an interior space. In the preferred embodiment, the housing has a length of about 5 and ½ inches, a width of about 2 and ½ inches, and a height of ½ of an inch. The top face has a square opening 14 formed therein with a recessed peripheral lip 16 formed about a periphery thereof. For reasons that will become apparent hereinafter, the end faces each have an elongated slot 18 extending between the side faces and further positioned adjacent the bottom face of the housing. The thickness of each slot is preferably just large enough for allowing only a single lottery ticket to pass therethrough.

Figure 3:
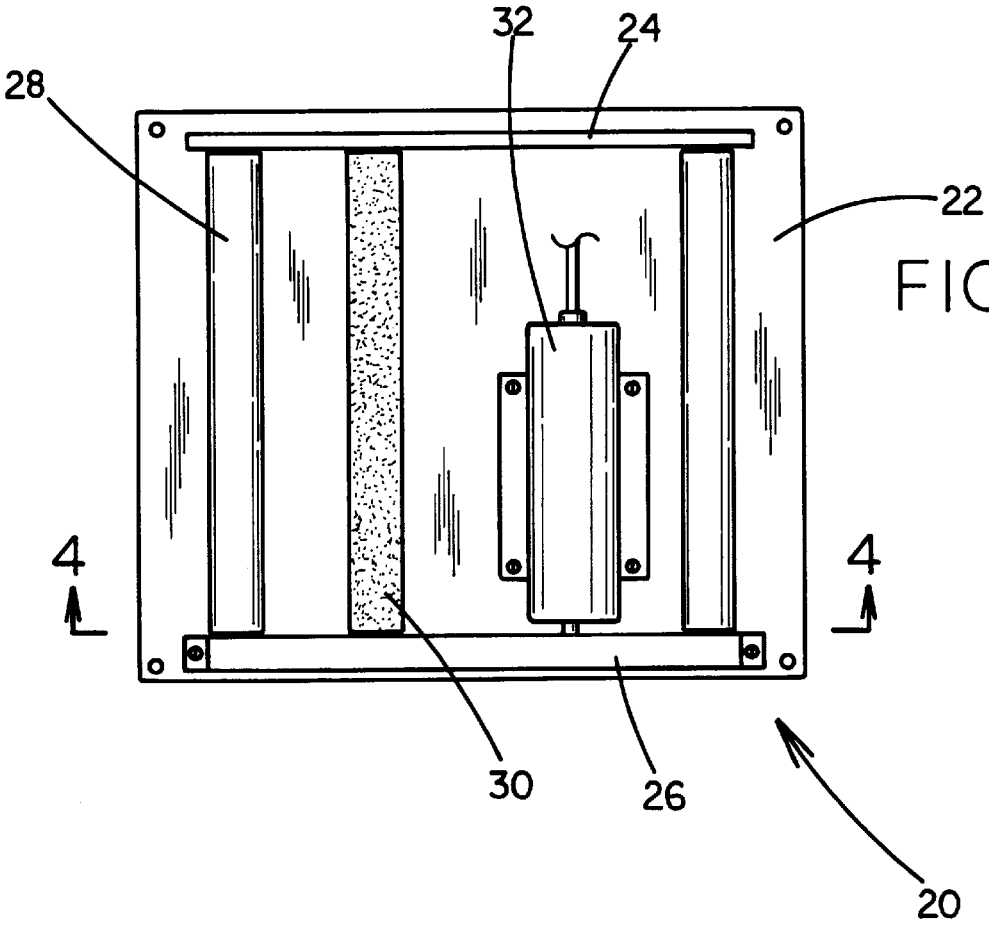
FIG. 3 is a bottom view of the scratch assembly of the present invention.
Figure 4:
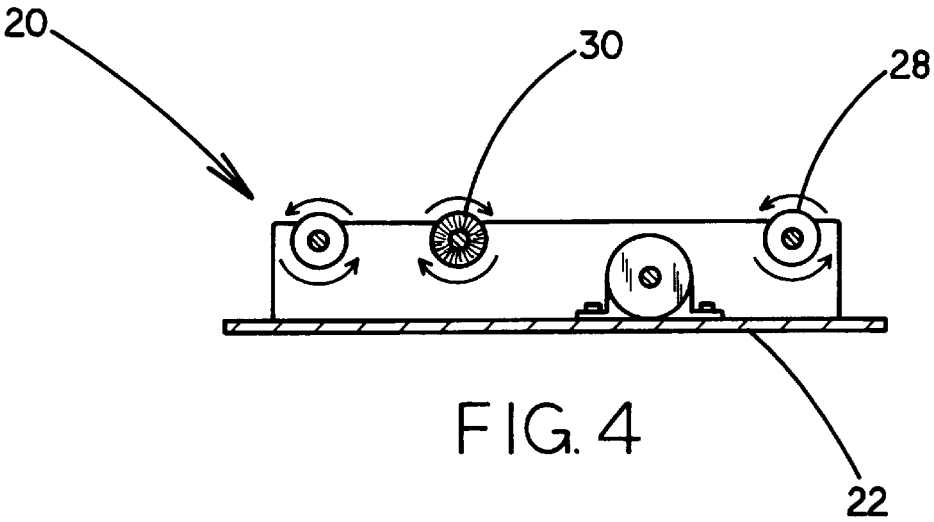
FIG. 4 is a side view of the scratch assembly of the present invention.

As best shown in FIGS. 3 & 4, a scratch assembly 20 is provided including a planar square plate 22 with a top face, a bottom face, and a periphery formed therebetween. The bottom face includes an elongated linear rectangular strip 24 integrally coupled thereto and extending downwardly therefrom along one of the edges thereof. An elongated linear rectangular box 26 is also coupled to the bottom face of the scratch assembly and extends downwardly therefrom along one of the edges opposite that associated with the strip.

A pair of elongated elastomeric cylindrical rollers 28 are included with a smooth outer surface rotatably coupled between the strip and box at opposite ends thereof. An elongated brush 30 with a cylindrical configuration is also included. A plurality of wire bristles extend radially from the brush. The brush is rotatably coupled between the strip and box. It should be noted that both the rollers and brush have a length equal to a distance between the box and strip.

During use, the scratch assembly is adapted to be removably secured to the housing such that the brush and rollers are situated within the interior space of the housing in abutment with the bottom face of the housing. Such removably coupling is preferably accomplished by way of holes and screws and is suitable for allowing a user to empty the contents of the housing. Further in such position, the bottom face of the plate of the scratch assembly is in abutment with the peripheral lip associated with the opening of the housing.

Also included is a motor 32 mounted to the bottom face of the scratch assembly for rotating upon the receipt of power. Associated therewith is an unillustrated gear assembly situated within the box and connected to a rotor of the motor, brush and rollers. Upon the rotation of the motor, the gear assembly is adapted to rotate the rollers in a first direction and the brush in a second direction opposite the first direction. To accomplish this, a gear is mounted to ends of the rollers and brush. Further, an odd number of gears are coupled between the rollers and rotor and an even number of gears are coupled between the brush and rotor. As such, when the rollers are rotated, a lottery ticket may be situated within one of the slots of the housing and the same is slid through the housing beneath the brush so that scratch off material, or Latex, of the lottery ticket is removed.

For manually controlling the motor, a slide switch 36 is mounted on the top face of the housing and connected between the motor and at least one battery. The switch has a first orientation for supplying power to the motor and a second orientation for precluding the supply of power to the motor. A battery compartment 38 is preferably mounted to the top face of the housing adjacent the switch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lottery scratch off device comprising, in combination:

a housing having a rectilinear configuration with a top face, a bottom face, a pair of elongated side faces, and a pair of short end faces thereby defining an interior space, the top face having a square opening formed therein with a recessed peripheral lip formed about a periphery thereof, the end faces each having an elongated slot extending between the side faces and further positioned adjacent the bottom face of the housing;

a scratch assembly including a planar square plate with a top face, a bottom face, and a periphery formed therebetween, the bottom face including an elongated linear rectangular strip integrally coupled thereto and extending downwardly therefrom along one of the edges thereof, an elongated linear rectangular box coupled thereto and extending downwardly therefrom along one of the edges opposite that associated with the strip, a pair of elongated elastomeric cylindrical rollers with a smooth outer surface rotatably coupled between the strip and box at opposite ends thereof, and an elongated brush with a cylindrical configuration and a plurality of wire bristles extending radially therefrom with the brush rotatably coupled between the strip and box, whereby the scratch assembly is adapted to be secured to the housing such that the brush and rollers are situated within the interior space of the housing in abutment with the bottom face of the housing and the bottom face of the scratch assembly is in abutment with the peripheral lip associated with the opening of the housing;

a motor mounted to the bottom face of the scratch assembly for rotating upon the receipt of power;

a gear assembly situated within the box and connected to a rotor of the motor, brush and rollers, the gear assembly adapted to rotate the rollers in a first direction and the brush in a second direction opposite the first direction upon the rotation of the motor, whereby upon the rotation of the rollers, a lottery ticket may be situated within one of the slots of the housing and the same is slid through the housing beneath the brush so that scratch off material of the lottery ticket is removed; and a switch mounted on the top face of the housing and connected between the motor and at least one battery, the switch having a first orientation for supplying power to the motor and a second orientation for precluding the supply of power to the motor.

2. A lottery scratch off device comprising:

a housing having a rectangular shape with a top face, a bottom face, a pair of elongated side faces, and a pair of short end faces thereby defining an interior space, the end faces each having an elongated slot extending between the side faces and further being positioned adjacent the bottom face of the housing, the top face having an opening therein with a recessed peripheral lip formed about a periphery thereof;

a scratch assembly including a plate with a top face, a bottom face, and a periphery, the bottom face including an elongated linear rectangular strip integrally coupled thereto and extending downwardly therefrom along one of the edges thereof, an elongated box coupled thereto and extending downwardly therefrom along one of the edges opposite that associated with the strip, a pair of elongated elastomeric cylindrical rollers with a smooth outer surface rotatably coupled between the strip and box at opposite ends thereof, and an elongated brush with a cylindrical configuration and a plurality of bristles extending radially therefrom with the brush rotatable coupled between the strip and box, whereby the scratch assembly is secured to the housing with the brush and rollers situated within the interior space of the housing in abutment with the bottom face of the housing and the bottom face of the scratch assembly is in abutment with the peripheral lip associated with the opening of the housing;

a motor mounted to the bottom face of the scratch assembly for rotating upon the receipt of power;

a gear assembly situated within the box and connected to a rotor of the motor, brush and rollers, the gear assembly adapted to rotate the rollers in a first direction and the brush in a second direction opposite the first direction upon the rotation of the motor, whereby upon the rotation of the rollers, a lottery ticket may be situated within one of the slots of the housing and the same is slid through the housing beneath the brush so that scratch off material of the lottery ticket is removed; and a switch mounted on the top face of the housing and connected between the motor and at least one battery, the switch having a first orientation for supplying power to the motor and a second orientation for precluding the supply of power to the motor.

* * * * *